US012788153B2

(12) United States Patent
Aldrich et al.

(10) Patent No.: US 12,788,153 B2
(45) Date of Patent: Nov. 10, 2026

(54) ARM SUPPORT

(71) Applicant: MillerKnoll, Inc., Zeeland, MI (US)

(72) Inventors: John F. Aldrich, Grandville, MI (US); Timothy Allen Hoogland, Zeeland, MI (US)

(73) Assignee: MillerKnoll, Inc., Zeeland, MI (US)

( * ) Notice: Subject to any disclaimer, the term of this patent is extended or adjusted under 35 U.S.C. 154(b) by 255 days.

(21) Appl. No.: 18/481,671

(22) Filed: Oct. 5, 2023

(65) Prior Publication Data

US 2024/0115050 A1 Apr. 11, 2024

Related U.S. Application Data

(60) Provisional application No. 63/413,459, filed on Oct. 5, 2022.

(51) Int. Cl.
*A47C 7/54* (2006.01)
*A47C 16/00* (2006.01)

(52) U.S. Cl.
CPC ..... *A47C 7/541* (2018.08); *A47C 7/546* (2013.01); *A47C 16/00* (2013.01)

(58) Field of Classification Search
CPC ..... A47C 7/541; A47C 7/546; A47C 16/00
USPC ..... 248/118–118.5
See application file for complete search history.

(56) References Cited

U.S. PATENT DOCUMENTS 4,895,039 A 1/1990 Hegg
4,914,976 A 4/1990 Wyllie
5,074,501 A * 12/1991 Holtta ..... B43L 15/00 248/281.11
5,380,065 A * 1/1995 Rohrer ..... A47C 1/0308 297/411.37
5,752,683 A * 5/1998 Novis ..... A47C 1/0307 248/218.1
5,931,536 A * 8/1999 Wu ..... A47C 1/0308 248/404
5,961,085 A * 10/1999 Navarro ..... A47C 16/00 5/624
5,975,640 A * 11/1999 Chen ..... A47C 1/03 297/411.31

(Continued)

FOREIGN PATENT DOCUMENTS

CN 106606137 A 5/2017
CN 216416571 U 5/2022

OTHER PUBLICATIONS

International Patent Office Search Report and Written Opinion for Application No. PCT/US 23/34583 dated Jan. 8, 2024 (11 pages).

(Continued)

*Primary Examiner* — Muhammad Ijaz
(74) *Attorney, Agent, or Firm* — Michael Best & Friedrich LLP

(57) ABSTRACT

An arm support including a mounting bracket configured to mount the arm support to a supporting structure, a track supported by the mounting bracket, a forearm support configured to support a forearm of a user, a linear bearing allowing a first degree of freedom of movement for the forearm support, a rotary bearing allowing a second degree of freedom of movement for the forearm support, and a gimbal joint allowing a third degree of freedom of movement for the forearm support.

19 Claims, 6 Drawing Sheets

(56) References Cited

U.S. PATENT DOCUMENTS 6,003,940 A * 12/1999 Jackson ..... A47C 7/543 297/217.3
6,042,064 A * 3/2000 Hong ..... A47B 21/0371 248/278.1
6,045,191 A * 4/2000 Piretti ..... A47C 1/03 297/411.37
6,074,012 A * 6/2000 Wu ..... A47C 1/03 297/411.31
6,076,891 A * 6/2000 Bernhardt ..... A47C 7/541 297/411.31
6,213,556 B1 * 4/2001 Chen ..... A47C 1/03 297/411.37
7,066,546 B2 * 6/2006 Trego ..... A47C 1/0307 297/411.36
7,222,826 B1 5/2007 Berglund
8,016,360 B2 * 9/2011 Machael ..... A47C 1/0305 297/411.37
8,881,616 B2 * 11/2014 Dize ..... G05G 9/047 345/161
9,700,145 B1 * 7/2017 Wang ..... A47C 7/546
10,143,310 B1 * 12/2018 Wang ..... A47C 7/541
10,537,175 B2 * 1/2020 Chen ..... A47C 7/541
10,537,176 B2 * 1/2020 Bock ..... A47C 1/0303
10,758,052 B1 * 9/2020 Lai ..... A47C 7/541
10,786,082 B1 * 9/2020 Lai ..... A47C 1/0308
11,089,876 B2 * 8/2021 Chen ..... A47C 7/541
11,369,204 B2 * 6/2022 Bock ..... A47C 1/0308
11,849,861 B2 * 12/2023 Chen ..... A47C 7/541
2002/0070598 A1 * 6/2002 Perl ..... A47C 1/03 297/411.35
2002/0130226 A1 9/2002 Nogueira
2011/0219899 A1 9/2011 Dize et al.
2011/0248543 A1 * 10/2011 Hitchcock ..... A47C 1/03 297/411.36
2020/0128964 A1 * 4/2020 Fang ..... A47C 7/541
2020/0383486 A1 * 12/2020 Wang ..... A47C 7/541
2021/0037981 A1 * 2/2021 Serena ..... A47C 1/0308
2021/0259427 A1 * 8/2021 Chen ..... A47C 7/541
2022/0031065 A1 2/2022 Kwon et al.
2022/0031076 A1 * 2/2022 Sharpe ..... B60N 2/20
2022/0031079 A1 * 2/2022 Antonucci ..... A47C 16/00
2022/0175142 A1 * 6/2022 Zhou ..... A47C 1/0305
2022/0312966 A1 * 10/2022 Chen ..... A47C 7/541
2022/0354260 A1 * 11/2022 Ruzicka ..... A47C 11/005
2024/0115050 A1 * 4/2024 Aldrich ..... A47C 7/541
2024/0407555 A1 * 12/2024 Hsieh ..... A47C 1/0305
2025/0031856 A1 * 1/2025 Yoon ..... A47C 1/0307
2025/0213046 A1 * 7/2025 Stone ..... A47C 7/383

OTHER PUBLICATIONS

European Patent Office Search Report for Application No. 23875527.6 dated Mar. 24, 2026 (7 pages).

* cited by examiner

ARM SUPPORT

CROSS-REFERENCE TO RELATED APPLICATIONS

This application claims priority to U.S. Provisional Patent Application No. 63/413,459 filed Oct. 5, 2022, the entire content of which are incorporated herein by reference.

FIELD OF INVENTION

The present invention relates generally to an arm support to support a user's arm and, in particular, to an arm support for a chair or a desk.

BACKGROUND

Chairs and desks are developing to accommodate users who stream live or play games (i.e., video games). The users require customization of their devices such as desk height, chair position, and the like.

SUMMARY

In one aspect, the invention provides, an arm support including a mounting bracket configured to mount the arm support to a supporting structure, a track supported by the mounting bracket, a forearm support configured to support a forearm of a user, a linear bearing allowing a first degree of freedom of movement for the forearm support, a rotary bearing allowing a second degree of freedom of movement for the forearm support, and a gimbal joint allowing a third degree of freedom of movement for the forearm support.

In another aspect, an arm support including a mounting bracket configured to mount the arm support to a supporting structure, a track supported by the mounting bracket, a forearm support configured to support a forearm of a user, a first mechanism allowing linear movement of the forearm support, a second mechanism allowing rotary movement of the forearm support, and a third mechanism allowing pivoting movement of the forearm support.

In yet another aspect, the invention provides a forearm support assembly configured to support a forearm of a user. The forearm support assembly includes a forearm support, a linear bearing allowing linear movement of the forearm support in a linear direction, a rotary bearing allowing rotary movement of the forearm support about a rotational axis that is perpendicular to the linear direction, and a gimbal joint allowing pivoting movement of the forearm support about a pivot axis that is perpendicular to the rotational axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

To avoid crowding the drawings with reference numbers for different ends, sides, etc. of parts of the chair, it will be presumed that one of ordinary skill will read this disclosure with the ordinary meaning of directional and positional terms in mind. Throughout this disclosure, for example, the terms "left," "right," "rear," "front," "forward," and "rearward" are used from the perspective of an occupant or user seated in the chair. Terms such as "top" and "bottom" are used with respect to the intended ordinary condition of the chair. The term "above" means that one component is positioned higher than another without necessarily being in the same vertical plane. The term "vertically above" means that one component is higher than another thing and in the same vertical plane. "Below" means a component is lower than another component without necessarily being in the same vertical plane, whereas "vertically below" means that the component is lower and also within the same vertical plane as the other component.

Figure 1:
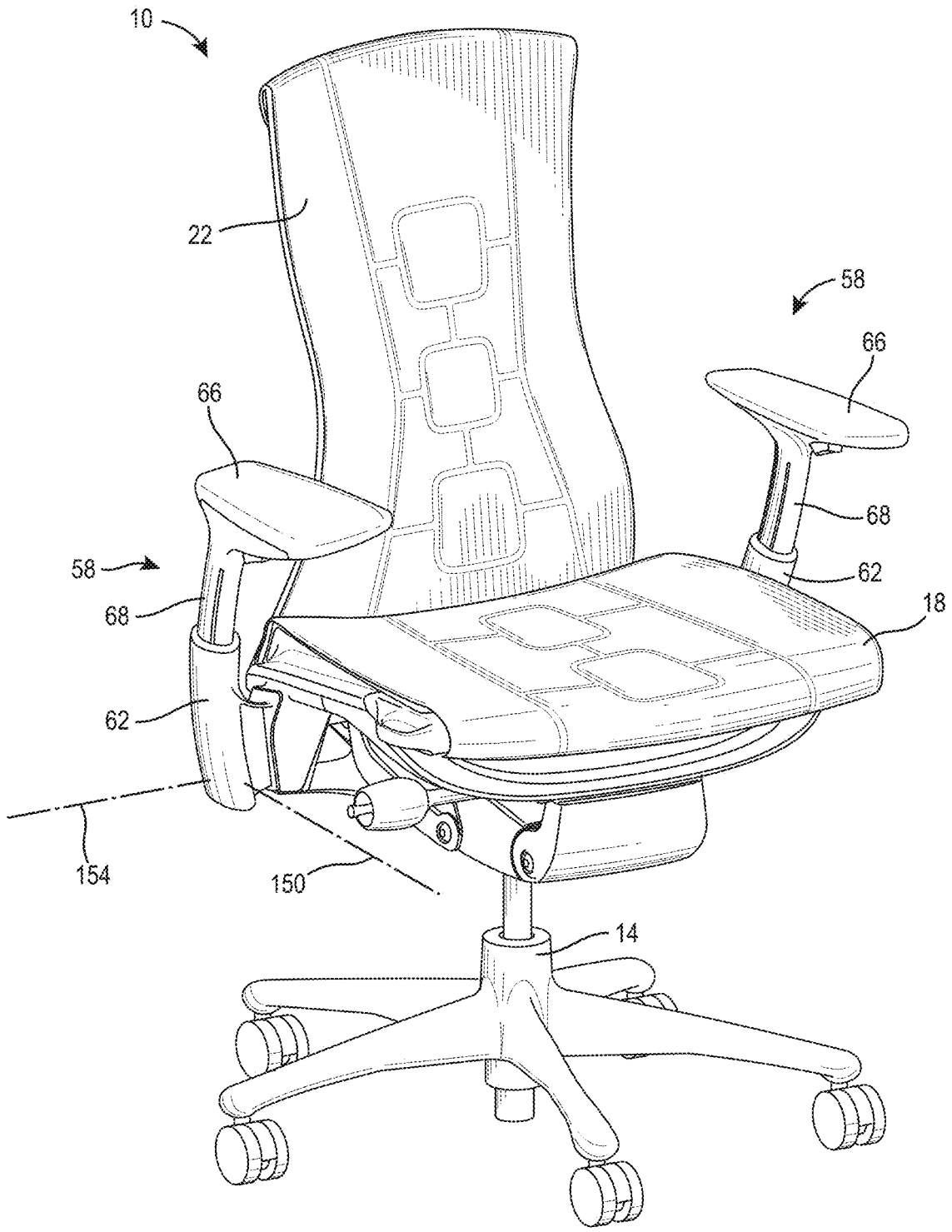
FIG. 1 is a perspective view of a seating structure.

FIG. 1 illustrates a seating structure 10, such as a chair. The seating structure 10 may also be referred to as a task chair or office chair. The seating structure 10 includes a base 14, a seat 18, and a backrest 22. Various aspects of the seating structure 10 may be adjustable to fit different sizes or preferences of users. In some embodiments, the seating structure 10 may further include a headrest assembly. The illustrated seating structure 10 is just one example of a seating structure. The seating structure 10 may take other forms (e.g., shapes, sizes, etc.) or may be a different type of seating structure (e.g., a stool, bench, lounge chair, sofa, settee, etc.).

The seating structure 10 further includes a pair of armrests 58. The illustrated armrests 58 are coupled to the base 14 and/or the seat 18. In other embodiments, the armrests 58 may be coupled to other portions of the seating structure 10. In the illustrated embodiments, the armrests 58 are disposed within cavities formed by side uprights 62. Each armrest 58 includes an arm support 66 that is coupled to a stem 68. The stem 68 is disposed within a corresponding one of the cavities of the side uprights 62. The arm support 66 may include a pad (e.g., foam padding) to provide cushion to a user's arms when sitting in the seating structure 10. In various embodiments, the armrests 58 are vertically adjustable, by way of the stem 68 moving relative to the side uprights 62. The armrests 58 may have various shapes and forms to provide different aesthetic appearances of the seating structure 10.

Figure 2:
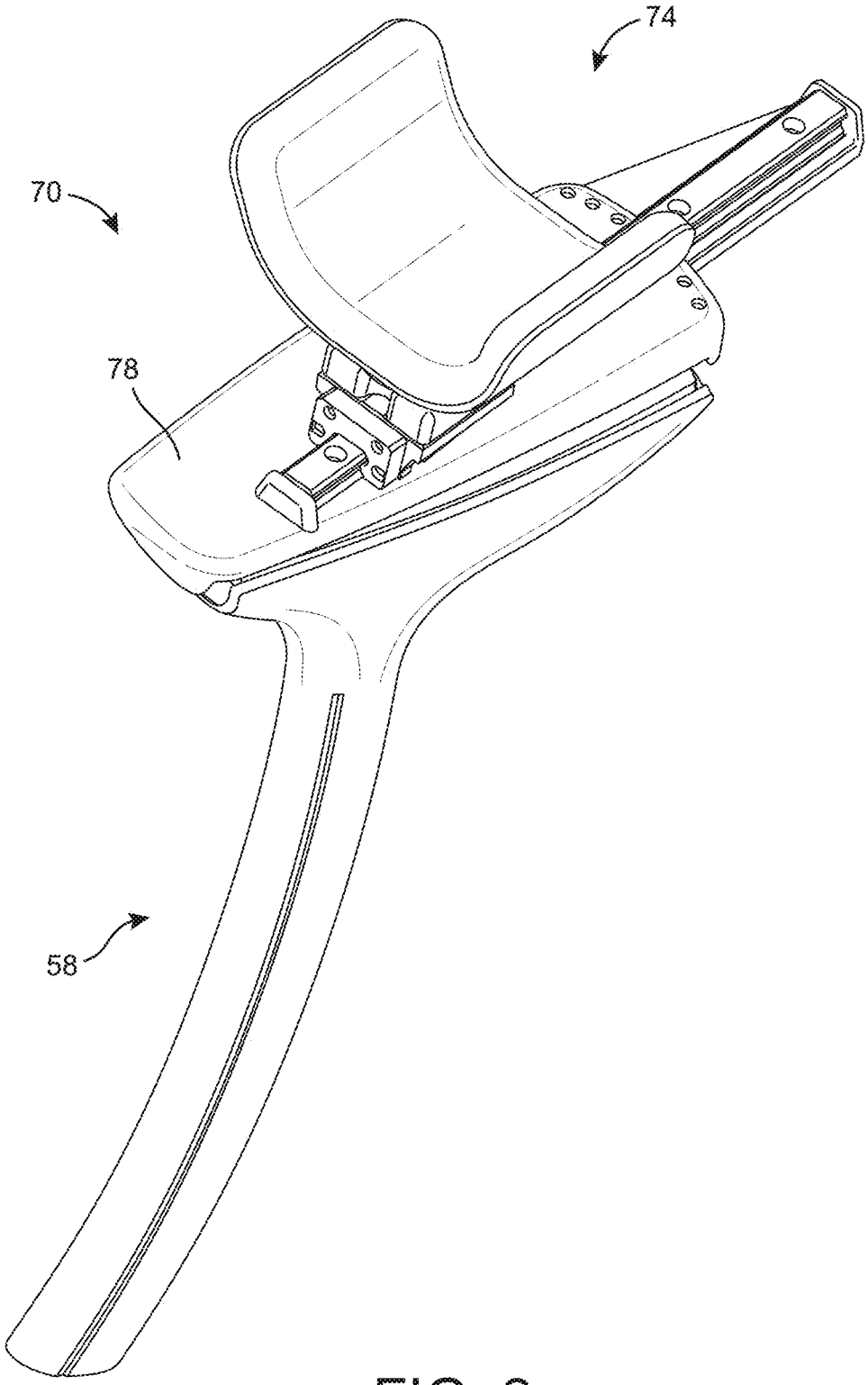
FIG. 2 is a perspective view of an armrest assembly for use with the seating structure of FIG. 1, the armrest assembly including an arm support according to one embodiment.

FIG. 2 illustrates an armrest assembly 70 including one of the armrests 58 discussed above and another arm support 74. The arm support 74 may be coupled to the armrest 58 after-market or the armrest 58 may come pre-equipped with the arm support 74 instead of the arm support 66 discussed above. In addition, the armrest assembly 70 may come with the seating structure 10 discussed above or may be an after-market addition. The armrest assembly 70 includes a support bracket 78 that may be coupled to a top side of the armrest 58 or the arm support 66.

Figure 3:
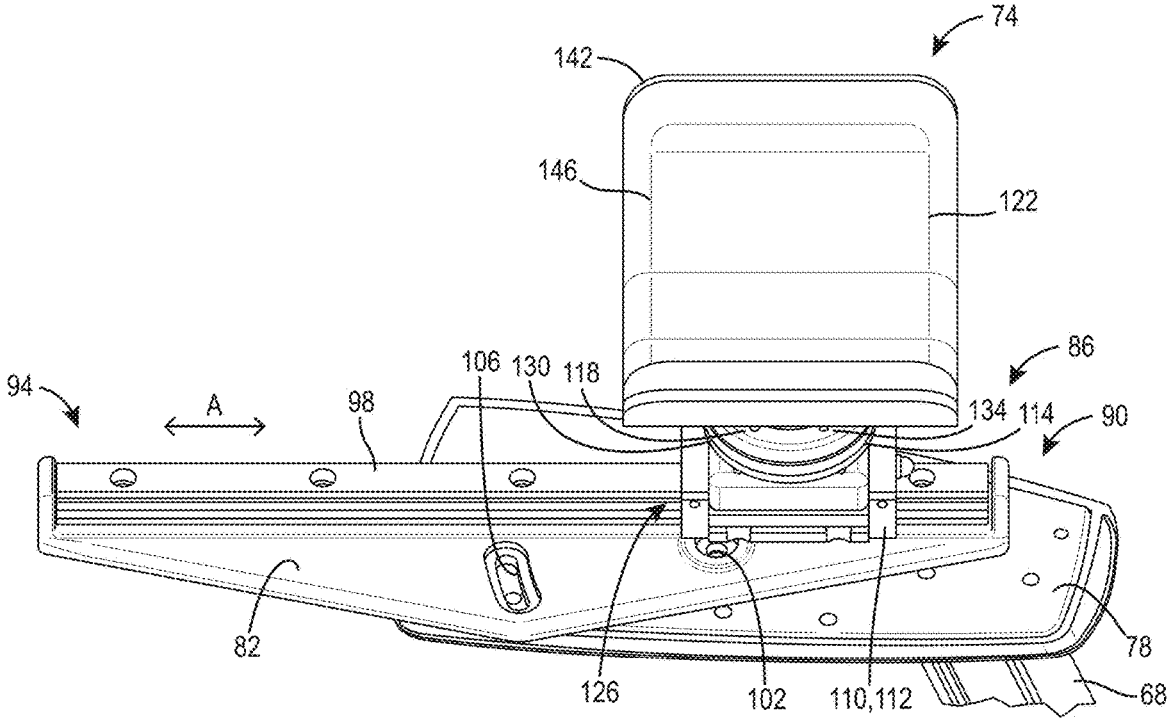
FIG. 3 is a perspective view of the arm support of FIG. 2.
Figure 4:
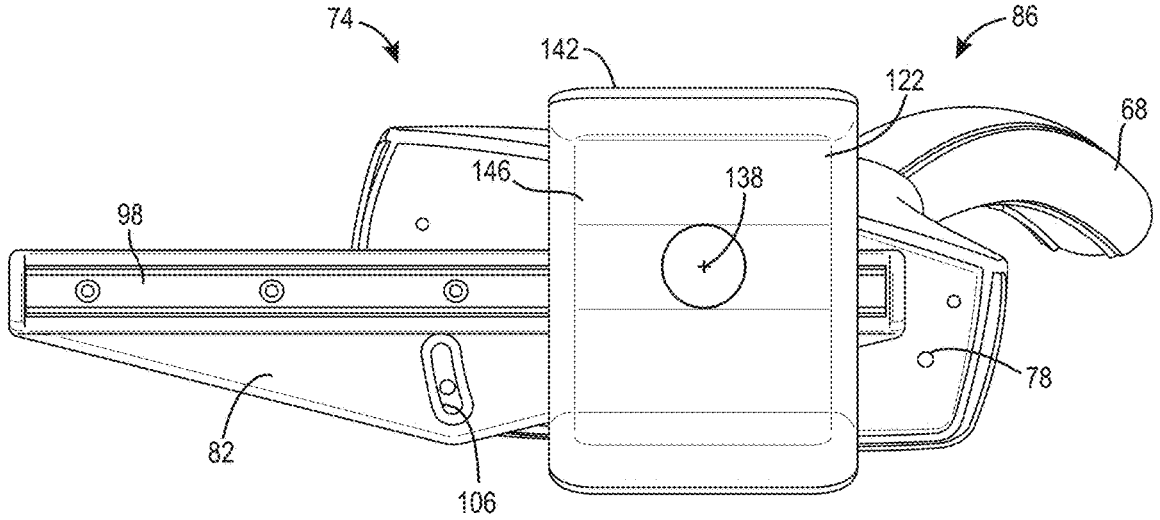
FIG. 4 is a top view of the arm support of FIG. 3.
Figure 5:
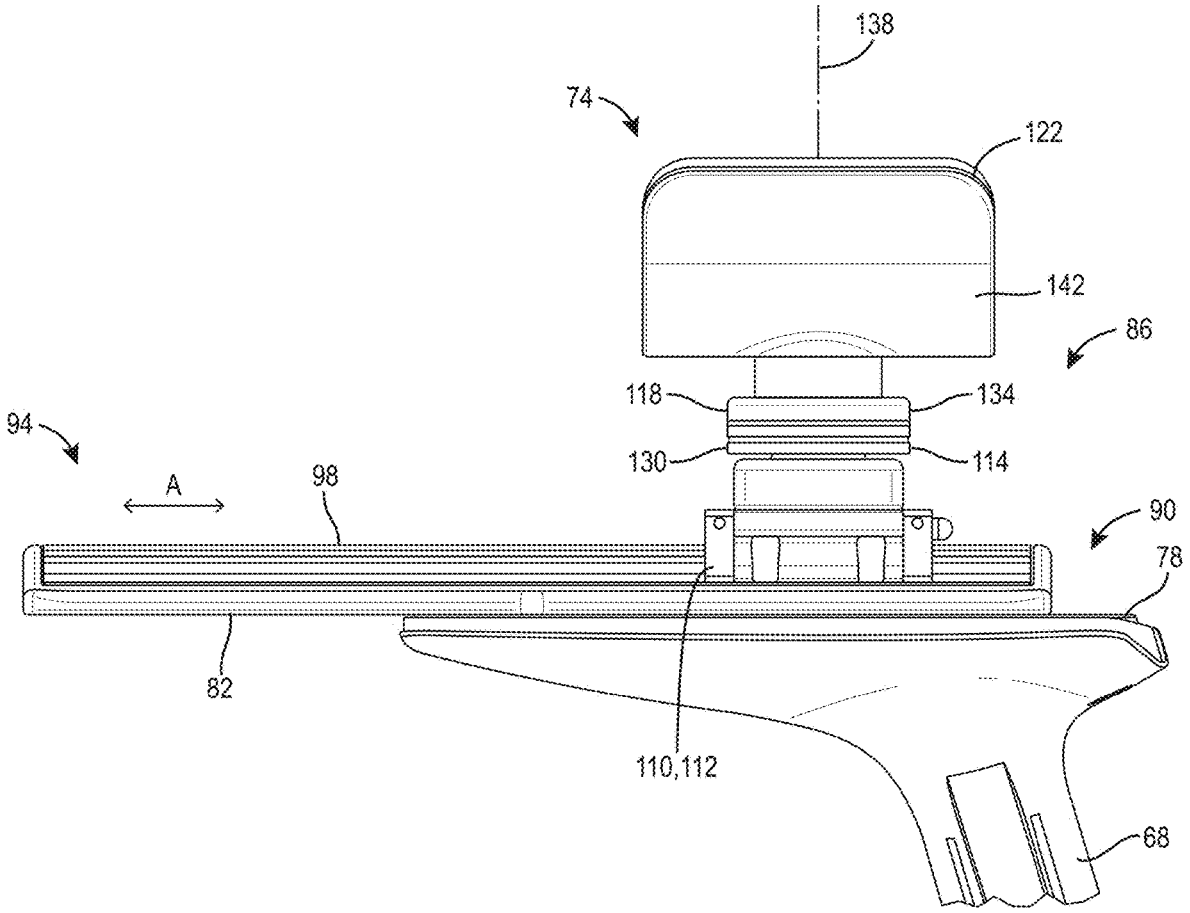
FIG. 5 is a side view of the arm support of FIG. 3.

With reference to FIGS. 3-5, the arm support 74 includes a mounting bracket 82 and a forearm support assembly 86 supported by the mounting bracket 82. The mounting bracket 82 may also be referred to as an adjustment bracket. The mounting bracket 82 may be coupled to the support bracket 78 using fasteners (e.g., screws, bolts, etc.) or the like. The mounting bracket 82 includes a first end 90, a second end 94 opposite the first end 90, and a track 98 extending between the first and second ends 90, 94. The mounting bracket 82 includes a pivot aperture 102 (FIG. 3) adjacent the first end 90 to receive a projection or a fastener. The pivot aperture 102 and projection/fastener pivotably couples the mounting bracket 82 to the support bracket 78, allowing the second end 94 to pivot relative to the support bracket 78. As such, the mounting bracket 82 may be positioned on the support bracket 78 in a plurality of positions and/or orientations. Further, the mounting bracket 82 includes an arcuate groove 106 that receives a projection or fastener extending from the top side of the support bracket 78. The arcuate groove 106 is located approximately midway between the first end 90 and the second end 94. The arcuate groove 106 and the projection/fastener help guide and limit pivoting movement of the mounting bracket 82 relative to the support bracket 78. The projection/fastener may be loosened to allow adjustment of an angular position of the mounting bracket 82 relative to the support bracket 78.

The illustrated forearm support assembly 86 includes a shuttle 110, a rotary bearing 114, a gimbal joint 118, and a forearm support 122. The shuttle 110 includes a recess 126 that corresponds to the cross-sectional shape of the track 98 to couple the forearm support assembly 86 to the mounting bracket 82. The shuttle 110 also includes a linear bearing 112 that allows linear movement along the track 98 in a first linear direction (indicated by arrows A). The linear bearing 112 may include ball detents or rollers to help move the shuttle 110 along the track 98. The linear bearing 112 provides a sufficient force to keep the forearm support assembly 86 in a nearly fixed position along the track 98. However, the linear bearing 112 allows for the force to be easily overcome if the user wants to change the position of the forearm support assembly 86 relative to the mounting bracket 82. The linear bearing 112, therefore, is part of a first mechanism that allows linear movement of the forearm support 122 relative to the mounting bracket 82.

The rotary bearing 114 is supported on a top side of the shuttle 110. The rotary bearing 114 is defined between a first circular flange 130 extending from the shuttle 110 and a second circular flange 134 of the gimbal joint 118. The rotary bearing 114 allows rotational movement of the forearm support 122 about a rotational axis 138 that is generally perpendicular to the first linear direction A. Similar to the linear bearing 112, the rotary bearing 114 provides sufficient force to keep the forearm support 122 in a nearly fixed rotational position. However, the force can easily be overcome if the user wants to change the angular position of the forearm support 122 relative to the shuttle 110. The rotary bearing 114, therefore, is part of a second mechanism that allows rotary movement of the forearm support 122 relative to the mounting bracket 82.

As mentioned above, the gimbal joint 118 is coupled to a top side of the rotary bearing 114 with the second circular flange 134. In the illustrated embodiment, the gimbal joint 118 is integrally formed with the forearm support 122. In other embodiments, the gimbal joint 118 may be a separate piece coupled to the forearm support 122 with a fastener or the like. The gimbal joint 118 allows relative pivoting of the forearm support 122 about an imaginary pivot axis that is perpendicular to the rotational axis 138 in multiple directions. In other words, the gimbal joint 118 allows the forearm support 122 to pivot about an axis perpendicular to the rotational axis 138 and can be moved 360 degrees about the rotational axis 138. The gimbal joint 118, therefore, is part of a third mechanism that allows pivoting movement of the forearm support 122 relative to the mounting bracket 82.

The forearm support 122 is configured to support the forearm of a user in a seated position. In some embodiments, the forearm support 122 may also be increased in size or shape to also or alternatively support an elbow of a user. The illustrated forearm support 122 includes a U-shaped bracket 142 and a cushion 146. In some embodiments, the lateral ends of the forearm support 122 may be adjustable to change the arc and/or width of the U-shaped bracket 142. For example, the outer ends may curve more inwards to accommodate a user with a smaller forearm size. In other embodiments, the forearm support 122 may have other shapes or sizes. For example, the forearm support 122 may include a generally flat pad. Alternatively, the forearm support 122 may only have one curved lateral end or side. In some embodiments, the forearm support 122 may include a strap that wraps entirely around a portion of a user's forearm.

During use of the armrest assembly 70, the user may first adjust macro-settings of the armrest assembly 70, including adjusting the vertical position of the stem 68 relative to the uprights 62 and adjusting the position of the mounting bracket 82 of the arm support 74 relative to the support bracket 78. In some embodiments, the arm support 74 can also move side-to-side relative to the seat 18 by pivoting the side uprights 62 about pivot axes 150 and/or sliding the side uprights 62 along axes 154. Adjusting the macro-settings fixes the position of the arm support 74 and the mounting bracket 82 relative to the armrest 58. Generally, adjusting the macro-settings includes adjusting the position of the armrest assembly 70 for use at a worksurface or desk at which a user may use an electronic device. The armrest assembly 70 can be positioned relative to the desk at an ideal position where a user can comfortably and conveniently use a mouse or other controller of the electronic device.

Once the macro-settings are fixed, the user can then actively adjust micro-settings of the forearm support assembly 86 during use, for example, while playing an interactive application (e.g., computer game, etc.) on the electronic device. While moving the mouse or controller dynamically, the linear bearing 112, the rotary bearing 114 and the gimbal joint 118 allow for the user to dynamically move the position of the forearm support 122 for the needed application. As such, the arm support 74 allows for convenient, natural, intuitive, and comfortable use of a mouse or controller while using an application. In further embodiments, each of the linear bearing 112, the rotary bearing 114, and the gimbal joint 118 may include a lock to selectively fix the position of the forearm support 122 and inhibit adjustment of the micro-settings. For example, a clip or fastener may be used to lock the linear position, the angular position, and/or the pivotable position of the forearm support assembly 86.

The linear bearing 112, the rotary bearing 114, and the gimbal joint 118, thereby, provide three degrees of freedom for the forearm support 122. In some embodiments, the armrest assembly 70 may only include a subset of the linear bearing 112, the rotary bearing 114, and the gimbal joint 118 to allow less than three degrees of freedom. For example, the armrest assembly 70 may only include one of the linear bearing 112, the rotary bearing 114, and the gimbal joint 118 to provide one degree of freedom for the forearm support 122. Alternatively, the armrest assembly 70 may include two of the linear bearing 112, the rotary bearing 114, and the gimbal joint 118 to provide two degrees of freedom for the forearm support 122. For example, the armrest assembly 70 may include the linear bearing 112 and the rotary bearing 114, may include the linear bearing 112 and the gimbal joint 118, or may include the rotary bearing 114 and the gimbal joint 118. In other embodiments, the armrest assembly 70 may provide more than three degrees of freedom for the forearm support 122.

Figure 6:
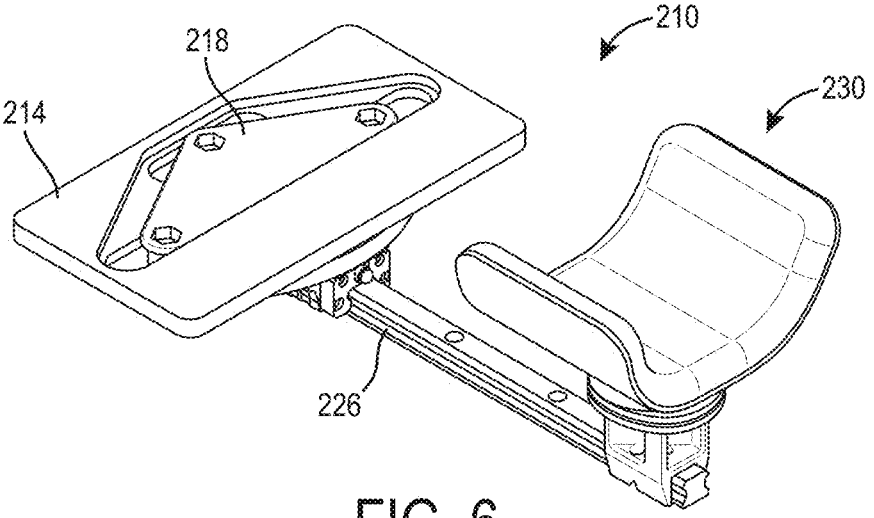
FIG. 6 is a perspective view of an arm support according to another embodiment.

FIG. 6 illustrates an arm support 210 according to another embodiment. The arm support 210 is similar to the arm support 74 discussed above with like reference features being represented with like reference numerals. In general, the arm support 210 is configured to be mounted directly to a worksurface (e.g., desk, table, counter, etc.) as opposed to the armrest of a seating structure.

Figure 7:
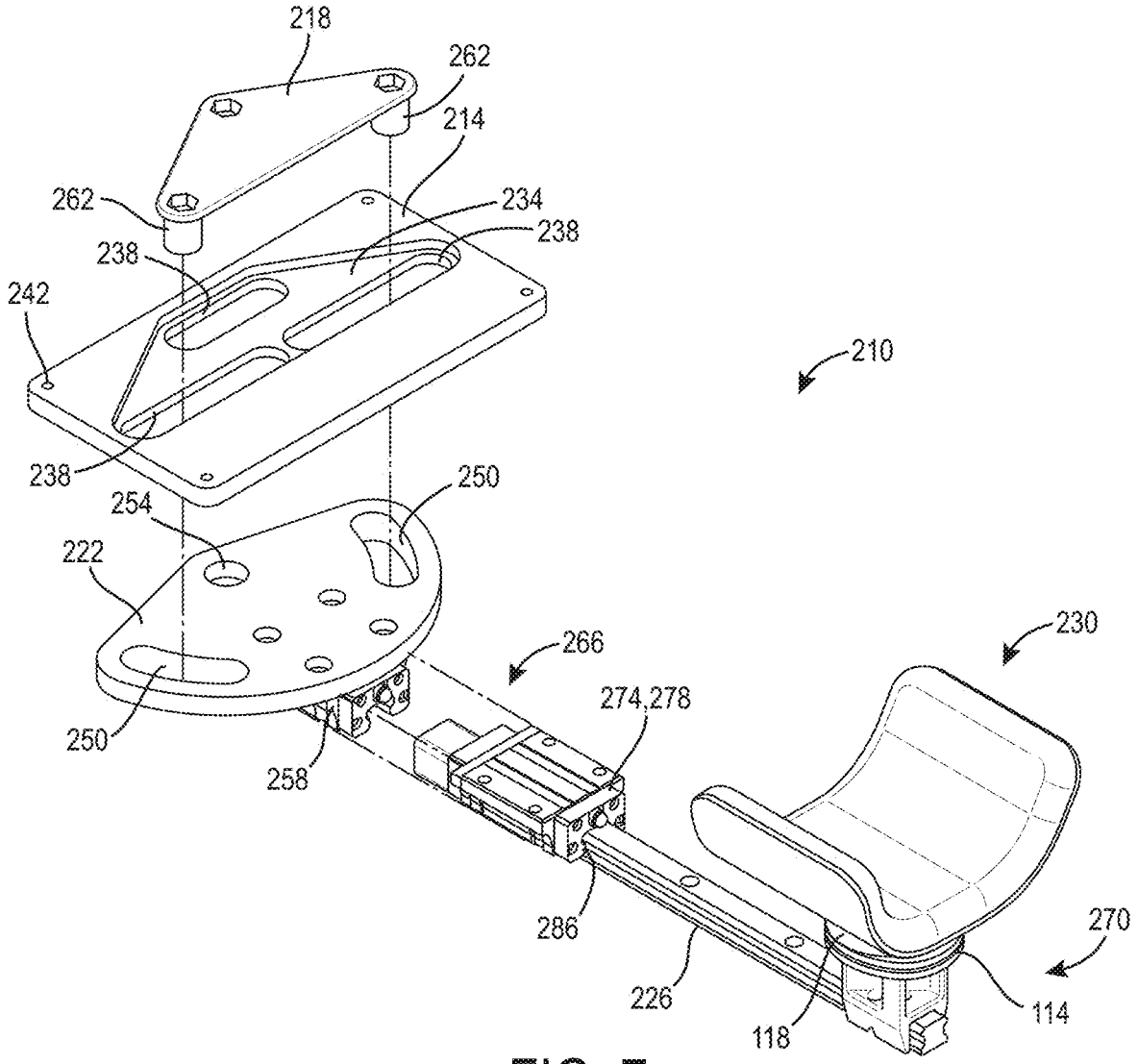
FIG. 7 is an exploded view of the arm support of FIG. 6.
Figure 8:
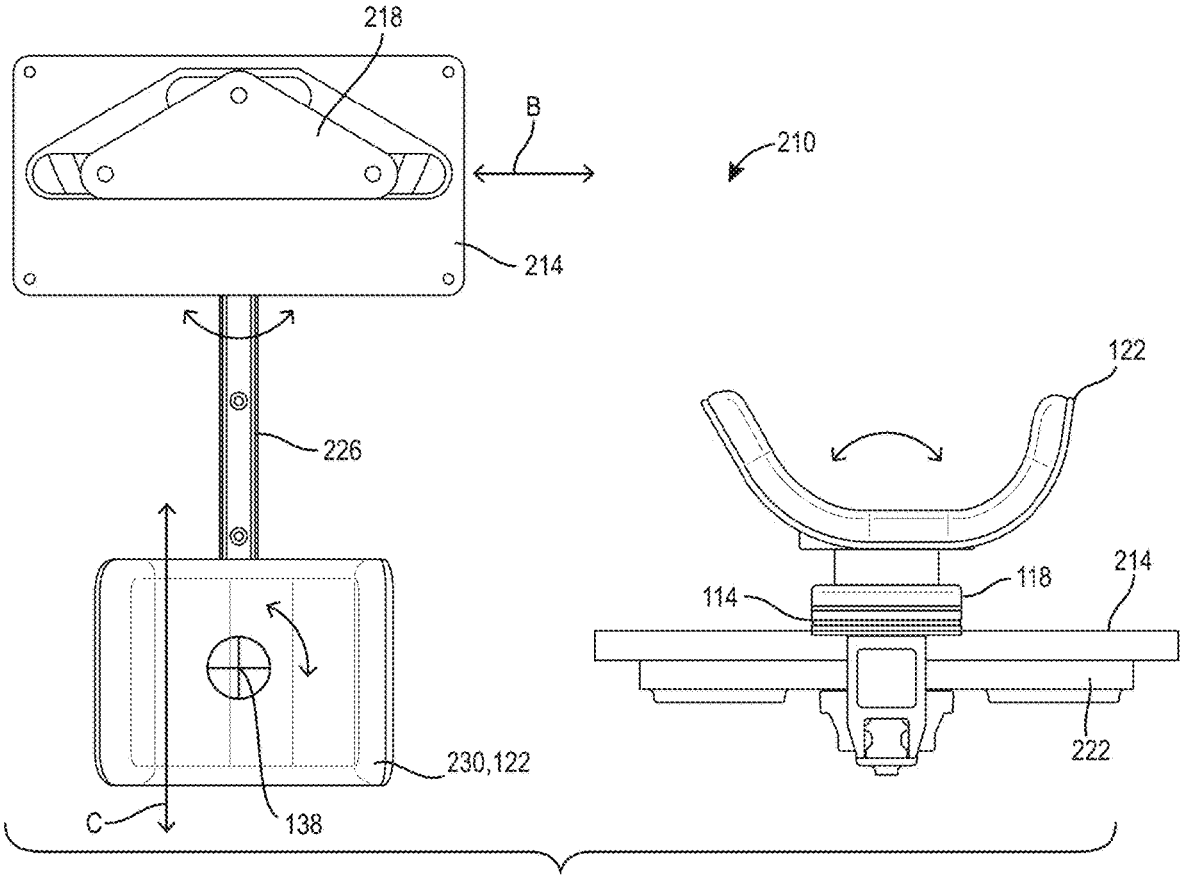
FIG. 8 are top and front views of the arm support of FIG. 6, illustrating motion of the arm support.
Figure 9:
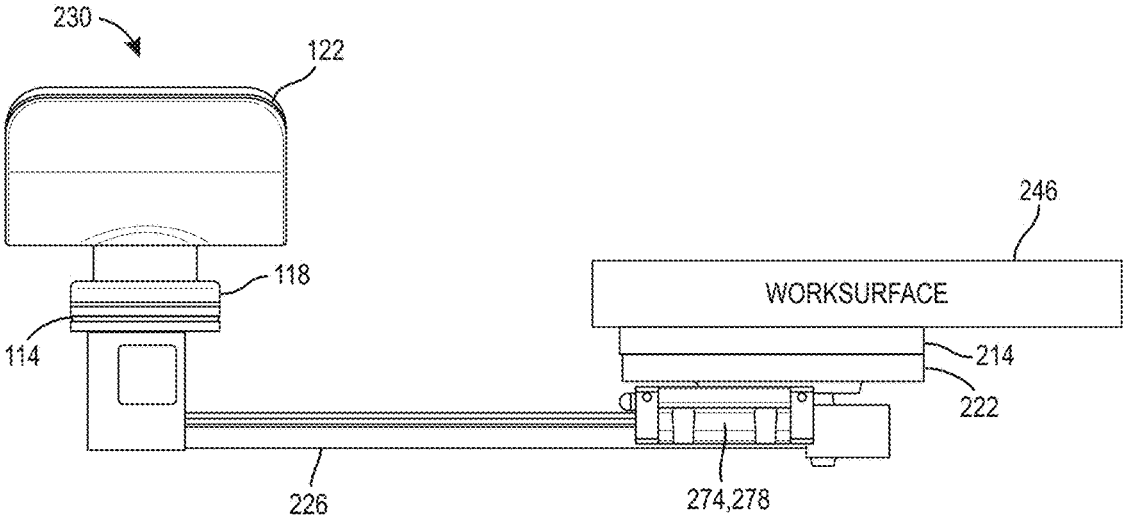
FIG. 9 is a side view of the arm support of FIG. 6.

With reference to FIG. 7, the arm support 210 includes a mounting bracket 214, an upper adjustment plate 218, a lower adjustment plate 222, a track 226, and a forearm support assembly 230. The mounting bracket 214 includes a recess 234 with a plurality of sliding apertures 238. In the illustrated embodiment, the mounting bracket 214 includes three sliding apertures 238. In other embodiments, the mounting bracket 214 may include more than or less than three sliding apertures 238. The sliding apertures 238 are elongated in a longitudinal direction (indicated by arrow B; FIG. 8) of the mounting bracket 214. The mounting bracket 214 also includes a plurality of fastening apertures 242 to secure the arm support 210 to a worksurface 246 (FIG. 9), such as a desk or other support. In the illustrated embodiment, the mounting bracket 214 is configured to be mounted to a lower surface of the worksurface 246. In other embodiments, the mounting bracket 214 may be configured to be mounted to an upper surface of the worksurface 246.

The lower adjustment plate 222 includes a plurality of arcuate sliding apertures 250 and a pivot aperture 254. In the illustrated embodiment, the lower adjustment plate 222 includes two arcuate sliding apertures 250. In other embodiments, the lower adjustment plate 222 may include more than or less than two arcuate sliding apertures 250. The lower adjustment plate 222 also includes a receiver 258 on a bottom side configured to receive the track 226. The upper adjustment plate 218 is generally triangular-shaped and includes pegs 262 extending from a bottom side positioned at each corner of the upper adjustment plate 218. The upper adjustment plate 218 is slidably received within the recess 234 of the mounting bracket 214 with one of the pegs 262 extending into each of the sliding apertures 238. In addition, when received in the recess 234, one of the pegs 262 extends into the pivot aperture 254 of the lower adjustment plate 222 and two of the pegs 262 extend into the arcuate sliding apertures 250, respectively.

The track 226 defines a first end 266, a second end 270 opposite the first end 266, and a first linear direction (indicated by arrow C; FIG. 8) between the first and second ends 266, 270. The track 226 supports the forearm support assembly 230 and a shuttle 274 with a linear bearing 278. The forearm support assembly 230 is similar to the forearm support assembly 86 and includes the forearm support 122, the rotary bearing 114, and the gimbal joint 118. However, the shuttle 274 is now supported separately on the track 226. The shuttle 274 is received within the receiver 258 of the lower adjustment plate 222 and the track 226 is supported within a recess 286 of the shuttle 274. In the illustrated embodiment, the shuttle 274 and the linear bearing 278 are fixed relative to the receiver 258 to allow the track 226 to slide along the linear bearing 278 in the first linear direction C.

With reference to FIG. 8, when assembled, the arm support 210 allows for the adjustability of the forearm support assembly 230 relative to the worksurface 246. First, the upper adjustment plate 218 and thus the track 226 is moveable relative to the mounting bracket 214 along the longitudinal direction B to adjust the position of the forearm support 122. The pegs 236 of the upper adjustment plate 218 slide within the sliding apertures 238 to adjust the lateral position of the track 226 and the forearm support assembly 230. In addition, the lower adjustment plate 222 may be pivoted about an axis defined by the pivot aperture 254 (FIG. 7) to adjust the angular position of the track 226 and thus the forearm support assembly 230. As the lower adjustment plate 222 pivots, the pegs 236 move within the arcuate sliding apertures 250. The angular position of the lower adjustment plate 222 and the lateral position of the upper adjustment plate 218 may be fixed in place using a lock or fastener. It should be noted, that adjusting the lateral position and the angular position of the forearm support assembly 230 corresponds to static adjustment of the macro-settings of the arm support 210 to fit the user.

With continued reference to FIG. 8, during use of the arm support 210, a user may slide the track 226 and thus the forearm support assembly 230 in the first linear direction C to move closer to or further away from the worksurface 246 due to the linear bearing 278 in the shuttle 274. In addition, the forearm support 122 may rotate about the rotational axis 138 due to the rotary bearing 114. Further, the forearm support 122 may pivot in multiple directions due to the gimbal joint 118. It should be noted that adjusting the position of the forearm support 122 through the linear bearing 278, the rotary bearing 114, and the gimbal joint 118 corresponds to dynamic adjustments of the micro-settings for a user to move while using the arm support 210. In other words, the linear bearing 278, the rotary bearing 114, and the gimbal joint 118 provide multiple degrees of freedom to adjust the position of the forearm support 122 while actively using a mouse or controller of an electronic device. In the illustrated embodiment, the linear bearing 278, the rotary bearing 114, and the gimbal joint 118 provide three dynamic degrees of freedom for the forearm support 122. In other embodiments, the forearm support 122 may include more than three dynamic degrees of freedom. In addition, similar to the arm support 74 described above, in some embodiments, the arm support 210 may include a subset of the linear bearing 278, the rotary bearing 114, and the gimbal joint 118 to provide less than three degrees of freedom.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. An arm support comprising:

a mounting bracket configured to mount the arm support to a supporting structure;

a track supported by the mounting bracket;

a forearm support configured to support a forearm of a user;

a linear bearing allowing a first degree of freedom of movement for the forearm support;

a rotary bearing allowing a second degree of freedom of movement for the forearm support; and a gimbal joint allowing a third degree of freedom of movement for the forearm support, the third degree of freedom being pivoting movement about multiple axes.

2. The arm support of claim 1, wherein the first degree of freedom is linear movement.

3. The arm support of claim 1, wherein the second degree of freedom is rotary movement.

4. The arm support of claim 1, wherein the mounting bracket is pivotable relative to the supporting structure to adjust an angular position of the forearm support.

5. The arm support of claim 1, wherein the track is pivotable relative to the mounting bracket to adjust an angular position of the forearm support.

6. The arm support of claim 1, wherein the linear bearing is positioned between the forearm support and the track, and wherein the forearm support is moveable along a length of the track to adjust a position of the forearm support.

7. The arm support of claim 1, wherein the linear bearing is positioned between the mounting bracket and the track, and wherein the track is moveable relative to the mounting bracket along a longitudinal direction of the mounting bracket to adjust a position of the forearm support.

8. The arm support of claim 1, wherein the linear bearing allows linear movement of the forearm support in a linear direction.

9. The arm support of claim 8, wherein the rotary bearing allows rotational movement of the forearm support about a rotational axis that is generally perpendicular to the linear direction.

10. The arm support of claim 9, wherein the pivot axes are perpendicular to the rotational axis.

11. The arm support of claim 10, wherein the pivot axes expand 360 degrees about the rotational axis.

12. The arm support of claim 1, wherein the forearm support includes a U-shaped bracket.

13. The arm support of claim 1, wherein the mounting bracket is configured to mount to a chair.

14. The arm support of claim 1, wherein the mounting bracket is configured to mount to a worksurface.

15. An arm support comprising:

a mounting bracket configured to mount the arm support to a supporting structure;

a track supported by the mounting bracket;

a forearm support configured to support a forearm of a user;

a first mechanism allowing linear movement of the forearm support;

a second mechanism allowing rotary movement of the forearm support about a rotational axis; and a third mechanism allowing pivoting movement of the forearm support about multiple axes;

wherein the third mechanism is coupled to the second mechanism along the rotational axis.

16. The arm support of claim 15, wherein the first mechanism includes a linear bearing.

17. The arm support of claim 15, wherein the second mechanism includes a rotary bearing.

18. The arm support of claim 15, wherein the third mechanism includes a gimbal joint.

19. A forearm support assembly configured to support a forearm of a user, the forearm support assembly comprising:

a forearm support;

a linear bearing allowing linear movement of the forearm support in a linear direction;

a rotary bearing allowing rotary movement of the forearm support about a rotational axis that is perpendicular to the linear direction; and a gimbal joint allowing pivoting movement of the forearm support in multiple directions about pivot axes that are perpendicular to the rotational axis.

* * * * *